US011618273B2

(12) United States Patent
Lien et al.

(10) Patent No.: US 11,618,273 B2
(45) Date of Patent: Apr. 4, 2023

(54) METHOD FOR INK JET DURABILITY AND ADHESION

(71) Applicant: ASSA ABLOY AB, Stockholm (SE)

(72) Inventors: Brent D. Lien, Minneapolis, MN (US); Dale James Ziebarth, Elk River, MN (US); Evan Pastor, Edina, MN (US); Tanya Jegeris Snyder, Edina, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 17/815,477

(22) Filed: Jul. 27, 2022

(65) Prior Publication Data

US 2022/0355606 A1 Nov. 10, 2022

Related U.S. Application Data

(63) Continuation of application No. 17/090,208, filed on Nov. 5, 2020, now Pat. No. 11,446,946.

(60) Provisional application No. 63/078,253, filed on Sep. 14, 2020.

(51) Int. Cl.
*B41M 7/00* (2006.01)
*B41J 11/00* (2006.01)

(52) U.S. Cl.
CPC ..... *B41M 7/0054* (2013.01); *B41J 11/002* (2013.01)

(58) Field of Classification Search
CPC ..... B41M 7/0054; B41M 5/0011; B41M 7/0045; B41M 7/0081; B41M 5/0064; B41M 5/0047; B41J 11/002; B41J 3/543; B41J 11/0015; B41J 11/00214; B41J 2/01; B41J 3/407; B41J 3/413
See application file for complete search history.

(56) References Cited

U.S. PATENT DOCUMENTS

| | | | |
|---|---|---|---|
| 11,446,946 | B2 | 9/2022 | Lien et al. |
| 2008/0074482 | A1 | 3/2008 | Makuta et al. |
| 2008/0081116 | A1 | 4/2008 | Makuta et al. |

(Continued)

FOREIGN PATENT DOCUMENTS

| | | |
|---|---|---|
| CN | 101835854 | 9/2010 |
| CN | 106414091 | 2/2017 |

(Continued)

OTHER PUBLICATIONS

U.S. Appl. No. 17/090,208, filed Nov. 5, 2020, Method for Ink Jet Durability and Adhesion.

(Continued)

*Primary Examiner* — Bradley W Thies
(74) *Attorney, Agent, or Firm* — Schwegman Lundberg & Woessner, P.A.

(57) ABSTRACT

Systems and techniques for improving ink jet ink durability and adhesion to a substrate. The techniques may include applying a varnish to the surface of the substrate, curing, in an initial curing step, the varnish with an ultraviolet (UV) lamp, and applying a pigmented ink to at least a portion of the substrate. The initial curing step may comprise pinning the varnish with the UV lamp in a low-power state. The techniques may additionally or alternatively include applying a layer of pigmented ink and varnish at substantially the same time, allowing the pigmented ink and varnish to at least partially mix, then pinning or curing the ink/varnish combination.

19 Claims, 5 Drawing Sheets

(56) References Cited

U.S. PATENT DOCUMENTS

| | | | | |
|---|---|---|---|---|
| 2016/0311234 | A1 | 10/2016 | Weglicki et al. | |
| 2018/0290477 | A1* | 10/2018 | Maas | B41M 7/009 |
| 2018/0326771 | A1 | 11/2018 | Aboutanos et al. | |
| 2022/0080762 | A1 | 3/2022 | Lien et al. | |

FOREIGN PATENT DOCUMENTS

| | | |
|---|---|---|
| CN | 114179538 | 3/2022 |
| EP | 1902849 | 3/2008 |
| EP | 2942203 | 11/2015 |
| WO | 2009053311 | 4/2009 |
| WO | 2015169661 | 11/2015 |
| WO | 2017041825 | 3/2017 |

OTHER PUBLICATIONS

"U.S. Appl. No. 17/090,208, Restriction Requirement dated Dec. 2, 2021", 7 pgs.
"European Application Serial No. 21181174.0, Extended European Search Report dated Jan. 7, 2022", 9 pgs.
"U.S. Appl. No. 17/090,208, Response filed Jan. 18, 2022 to Restriction Requirement dated Dec. 2, 2021", 6 pgs.
"U.S. Appl. No. 17/090,208, Non Final Office Action dated Feb. 10, 2022", 8 pgs.
"U.S. Appl. No. 17/090,208, Response filed May 10, 2022 to Non Final Office Action dated Feb. 10, 2022", 9 pgs.
"U.S. Appl. No. 17/090,208, Notice of Allowance dated Jun. 6, 2022", 5 pgs.
"Chinese Application Serial No. 202110583621.7, Office Action dated Nov. 8, 2022", w/English translation, 19 pgs.

* cited by examiner

METHOD FOR INK JET DURABILITY AND ADHESION

PRIORITY APPLICATION

This application is a continuation of U.S. patent application Ser. No. 17/090,208, filed Nov. 5, 2020, which claims priority to U.S. Provisional Application Ser. No. 63/078,253, filed Sep. 14, 2020, the disclosures of which are incorporated herein in their entirety by reference.

TECHNICAL FIELD

The present disclosure relates to improving durability and adhesion of ink jet ink to a substrate.

BACKGROUND

Use of ink jet ink on substrate surfaces, such as plastic, used for identification cards (e.g., government-issued licenses, workplace identification cards, or the like) require UV-curing of the ink, to dry the pigmented ink. As a part of the curing process, UV pinning, also known as gelling, can be used to cause the ink to thicken, to minimize the mixing of ink droplets, without fully drying the ink. Use of a clear varnish can also be used prior to the curing or pinning process to improve adhesion and durability of the ink.

SUMMARY

Described herein are systems and methods for improving ink jet ink durability and adhesion to a substrate. A system may generally include a scan assembly configured to be connected to an x-y gantry of an ink jet printer. The scan assembly may include a scanning sub-assembly comprising at least one print head, and an ultraviolet (UV) lamp configured to be connected, attached, mounted to, or the like, adjacent to (e.g., next to, on a side of, or the like) the print head. For example, the UV lamp may be attached adjacent to the print head using one or more bolts, screws, or the like. In an example, there may be multiple print heads forming a portion of the sub-assembly, and the UV lamp may be located on a leading side or a trailing side (e.g., a right or a left side) of the multiple print head "block". In another example, there may be two UV lamps, one located on each side of the print head, or the multiple print head block.

The scan assembly may be configured to be connected to, mounted on, attached to, or the like, an x-y gantry. The x-y gantry may allow the scan assembly to move in multiple directions (e.g., left-to-right, right-to-left, back-and-forth, or the like) to allow for printing on the substrate. The substrate may be formed from a material such as plastic, a synthetic material such as polyvinyl chloride (PVC), or another similar material, or a combination of similar materials (e.g., a polyester/vinyl blend, or the like). The substrate may include glass or metallic elements (or a combination thereof) such as an EMV chip in a credit or debit card. In an example, only a portion of the surface of the substrate (e.g., a portion of a front side and/or a back side of the substrate) may be printed on with pigmented ink. In another example, an entire surface (e.g., an entire front side, an entire back side, or both) may be printed on with pigmented ink.

In an example, the print head may contain a first channel and a second channel. The channels may be configured to contain (e.g., be filled with) ink or varnish. In an example, there may be three print heads on the sub-assembly, each containing two channels. In an example, the channels of one print head may contain a white ink, the channels of a second print head may contain a black ink, and the channels of a third print head may contain varnish. In an example, one of the channels containing varnish may contain a fluorescent mixed with the varnish. In an example, one or more of the channels of the print heads may contain a colored ink (e.g., yellow, cyan, or magenta) while another of the channels may contain a black ink.

The ink and varnish, once applied to the substrate, may be cured using the UV lamp included in the sub-assembly as described above. The UV lamp may be used at different power levels to dry the varnish and/or the pigmented ink. For example, the UV lamp may be moved over the substrate with varnish and/or pigmented ink applied as the scanning assembly moves along the x-y gantry. The UV lamp may be operated in a low-power or low-intensity state, a process also referred to as pinning, semi-curing, or gelling, which causes ink droplets or varnish to move to a higher viscosity state (e.g., to thicken), but not to completely dry, harden, or the like. Alternatively, the UV lamp may be operated at a higher-power state in order to fully cure the varnish and/or ink. The varnish may be cured separately from the ink, or a combination of ink and varnish may be cured at the same time.

In an example, a method for ink jet durability and adhesion to a substrate may include applying a varnish, which may be a substantially non-pigmented/clear polymer or a photoactivated polymer to a surface of the substrate. The method may further include curing the varnish in an initial curing step. This may include pinning or semi-curing the varnish with a low-power application of the UV lamp as described above. Another step of the method may include applying a pigmented ink to at least a portion of the cured varnish. An intermediate curing step may be included to cure the pigmented ink. This may include a semi-curing or pinning as described above to raise the viscosity of the pigmented ink, but not to fully cure the ink. The method may also include a final curing step, in which the combination of the pigmented ink and the varnish are fully cured with the UV lamp operating at a higher power, passing over the surface of the combination of the substrate, the varnish, and the pigmented ink.

In an example, the method may include, as a first step, applying a pigmented ink to at least a portion of the surface of the substrate. The method may further include applying a varnish to at least a portion of the substrate. In an example, applying the varnish may include applying varnish to only the portion of the substrate containing the previously applied pigmented ink (e.g., only applying varnish on top of the pigmented ink, and leaving the remainder of the substrate unvarnished). In an example, the pigmented ink may be cured in an intermediate curing step, which may be a semi-curing with the UV lamp operating at a low-power, after application of the pigmented ink, but before the final curing of the entire surface containing pigmented ink and varnish. Such as when multiple passes with the print heads are required to apply the pigmented ink to different portions of the substrate before the varnish is applied. Alternatively, the varnish may be applied to a portion of the substrate that does not contain the previously applied pigmented ink. In another example, the pigmented ink and the varnish may be applied at substantially the same time (e.g., in the same pass of the print heads) and cured or pinned at the same time.

The system and methods described herein may use a processor, such as a processor contained within a printer in which the system is included, or a processor external to the printer. For example, the processor may be used to control the movement of the scan assembly along the x-y gantry, for controlling the application of the varnish or the pigmented ink, controlling the operation and power level of the UV lamp, or the like.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Durability and adhesion of UV-cured ink jet ink are often desirable requirements of ink jet printing on a substrate. There are some substrates to which it is difficult to get pigmented ink to stick. Such substrates include, for example, metal, plastic, or other similar card substrates. Durability and adhesion are especially challenging when printing with heavily pigmented inks, such as black ink or white ink. Abrasion Resistance is proportional to ink thickness. The thicker the ink, the more abrasion resistant it is. Thick, heavily pigmented ink, such as black or white ink, generally takes longer to cure/dry than less pigmented ink.

Methods such as plasma surface activation, solvent cleaning, or use of adhesion primers may be employed to aid improving ink durability and adhesion, however, those methods can require extensive and expensive equipment because they can require an additional, separate, application method or a separate ink jet cartridge. Similarly, high-power, fixed, ultraviolet (UV) cure lamps which require water cooling can be employed to cure the ink down to the substrate. However, such curing lamps can be very expensive and inefficient. The systems and methods of this disclosure provide for printing on a substrate to an adequate thickness while allowing the pigmented ink to fully cure quickly, and without requiring additional equipment.

Figure 1:
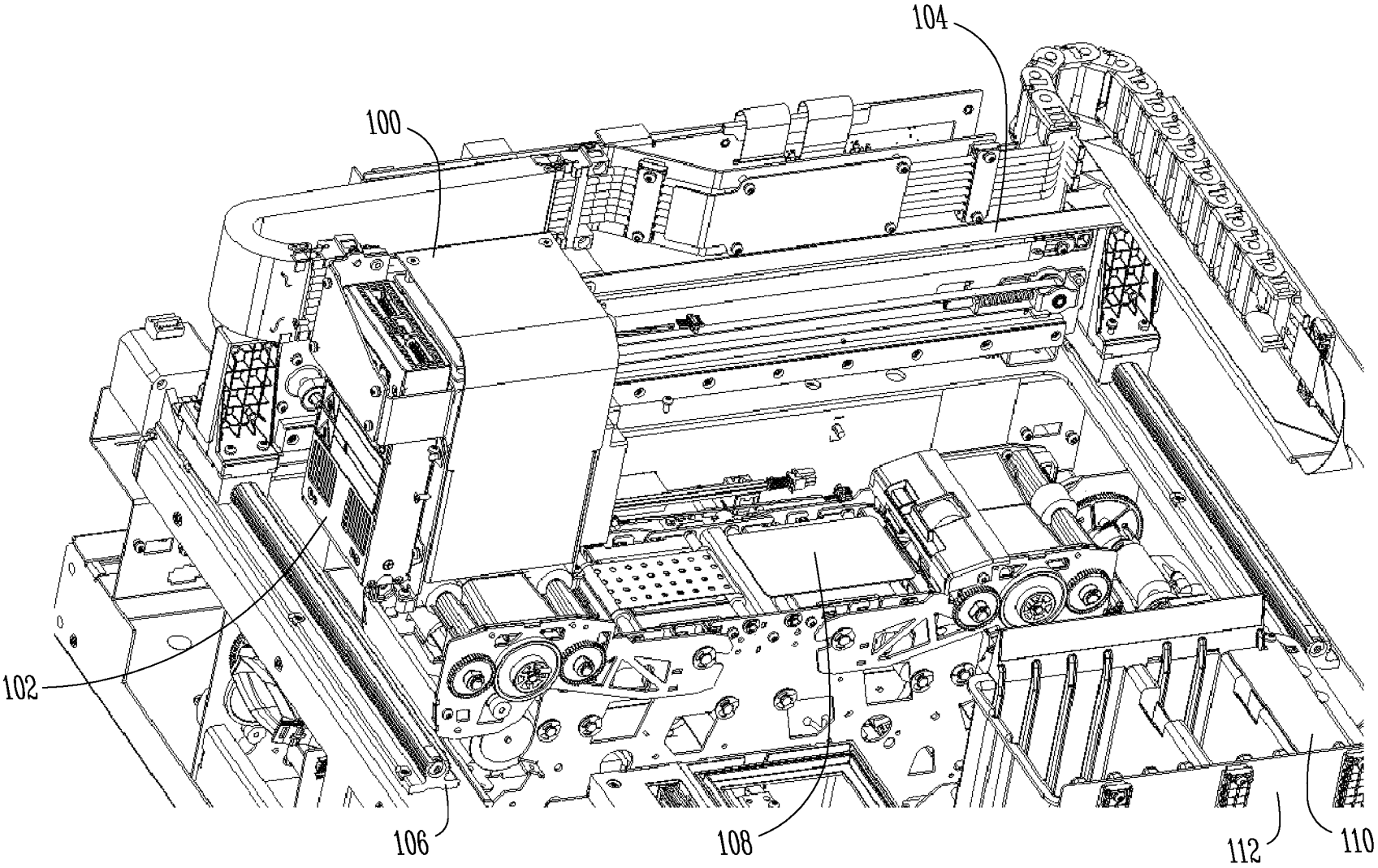
FIG. 1 illustrates an example of an interior of a printer including a system for printing to a substrate.

Particularly, described herein are systems and methods for ink jet durability and adhesion. FIG. 1 illustrates an example of an interior of a printer including a system for printing to a substrate. In an example, a card substrate 108 may be placed below a scan assembly 100. The scan assembly/print head carriage 100 may be mounted on an x-y gantry including an x direction scanning gantry 104 which allows the scan assembly 100 to move sideways/horizontally in a left-to-right or right-to-left direction, or more generally, along a first axis (e.g., an x-axis). The x-y gantry may further include at least one y-direction actuator/rail/scan gantry 106. The y-direction actuator 106 may allow the scan assembly to move substantially perpendicular to the x direction scanning gantry 104, such as in a front-to-back (e.g., back-and-forth) direction, or more generally, along a second axis (e.g., a y-axis). Allowing the scan assembly to move in such x and y directions allows for ink to cover up to an entire side of the surface of the card substrate 108 with ink without having to reposition the card substrate 108.

In an example, the card substrate 108 may be made or formed from a material such as plastic, metal, polyvinyl chloride (PVC), a polyester/vinyl blend, or the like. The scan assembly may make one or more passes over the card substrate 108, in either the x direction, the y direction, or a combination thereof, to eject/drop/spray/apply ink or varnish onto the surface (e.g., a front side or a back side) of the card substrate 108. The varnish may be a substantially non-pigmented/clear polymer, photoactivated polymer, a clear-coat, or the like. In an example, a UV cure lamp 102 may be located adjacent to the scan assembly 100. For example, located, connected, attached, or the like, to a side (e.g., a leading or trailing side) of the scan assembly 100. The UV cure lamp 102 is configured to direct, aim, or the like ultra-violet light on at least a portion of the card substrate 108 to cure/dry ink or varnish applied to the card substrate 108. The UV cure lamp 102 may include one or more UV lights (e.g., one or more UV bulbs), which may be LED lights/bulbs, or any similar lights/bulbs capable of emitting ultraviolet light. The UV cure lamp 102 may also be an arc lamp (e.g., a mercury arc lamp), or any other similar lamp designed to emit ultraviolet light onto a surface.

In an example, the interior of the printer may further include a print cartridge 110 located in a print cartridge carriage 112. The print cartridge carriage 112 may be configured to hold at least one print cartridge 110, each print cartridge containing an ink (e.g., black, white, cyan, yellow, magenta), an unpigmented varnish (e.g., a clear coat), or an unpigmented varnish mixed with another component, such as a fluorescent. In an example, there may be multiple print cartridges such as print cartridge 110 located, seated, inserted, or the like, into the print cartridge carriage 112. For example, there may be separate print cartridges for each color (e.g., black, white, cyan, yellow, or magenta), as well as a separate print cartridge for a varnish as described above.

Figure 2:
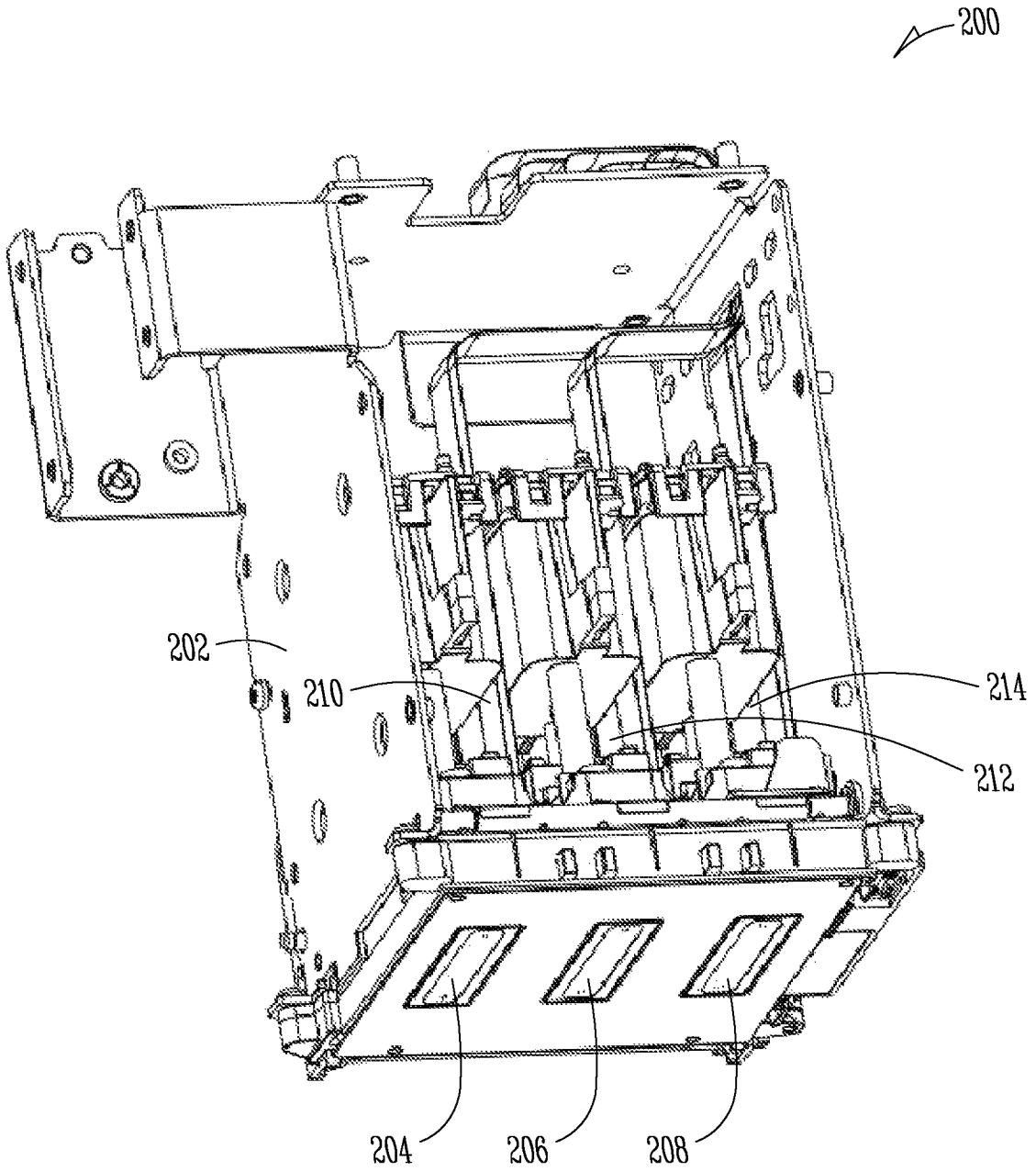
FIG. 2 illustrates an example of a scan sub assembly including a print head assembly and a UV lamp mounting surface.

FIG. 2 illustrates an example of a scan sub assembly including a print head assembly and a UV lamp mounting surface. A scan sub assembly may include at least one print head and a UV lamp mounting surface. The sub assembly may include multiple print heads as described below, the print heads configured to drop, eject, spit, or the like, ink onto a surface, such as the card substrate 108 described above. The scan sub assembly may include as many print heads as is required for a particular user's needs. The print heads may be connected to one or more print channels/header tanks which may be fed from one or more print cartridges such as print cartridge 110. The print channels may include one or more chambers which may contain, hold, or the like, pigmented ink or varnish (in the case of a single chamber channel/tank) or a combination of pigmented inks or varnish (in the case of a channel/tank with a dual chamber). For example, a dual chamber print channel/tank may contain yellow ink in one chamber and black ink in the other. Similarly, a dual chamber channel/tank may contain varnish in one tank and pigmented ink in the other. Or, a dual chamber channel/tank may contain varnish in both chambers, or may contain the same color pigmented ink in both chambers. The system may include any number of print channels with any combination of pigmented ink or varnish as needed.

In the specific example of FIG. 2, the scan assembly 100 may include a scan sub assembly 200, comprising print heads 204, 206, and 208 connected to print channels/chambers 210, 212, and 214, respectively. Ink may be directed (e.g., pumped) from one or more print cartridges, such as print cartridge 110 to one or more print channels 210, 212, or 214. In an example, each of the print channels 210, 212, and 214, may be dual channel/chamber (e.g., contain two chambers). Each chamber may contain ink or varnish. Each print channel 210, 212, 214, may feed, direct, or the like, ink to a print head 202, 204, 206, which may then apply the ink to at least a portion of a surface of the card substrate 108.

In an example, the two chambers of a print channel 210, 212, 214, may contain pigmented ink, or varnish, or a combination thereof. For example, one of the print heads 202, 204, 206 may contain varnish in both of its corresponding print channel 210, 212, or 214. Another of the print heads 202, 204, or 206 may contain cyan colored ink in one of the chambers of its corresponding print channel 210, 212, or 214 and black or white ink in the other chamber. Likewise, another of the print heads 202, 204, 206 may contain yellow pigmented ink in one chamber of its corresponding print channel 210, 212, or 214 and magenta pigmented ink in the other chamber.

Therefore, as shown for a non-limiting example, the scan sub assembly 200 may include a total of three print heads 202, 204, 206, connected to three print channels 210, 212, 214, with two chambers per print head, for a total of six chambers of ink or varnish. It is understood however, that the system may include any number of print heads and print channels. The scan sub assembly 200 may also include a mounting surface 202 to which the UV cure lamp 102 may be attached, secured, connected, or the like, such as with bolts, screws, or the like.

Figure 3A:
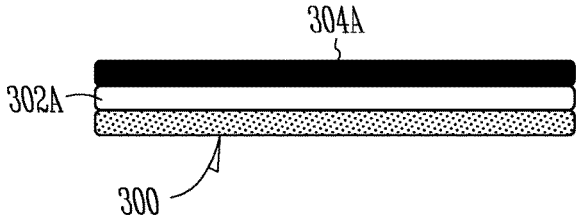
FIGS. 3A-3C illustrate examples of printing on and varnishing a substrate.
Figure 3B:
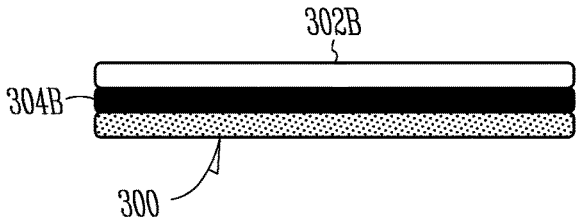
Figure 3C:
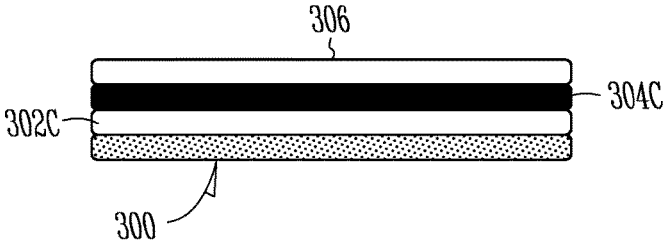

FIGS. 3A-3C illustrate examples of printing on and varnishing a substrate. In the example of FIG. 3A, a layer of varnish 302A may be applied to a substrate 300, such as the card substrate 108. The layer of varnish 302A may then be cured (e.g., fully cured or pinned/partially cured/semi-cured) using the UV cure lamp 102 before applying a layer of pigmented ink 304A to the varnish layer 302A. By applying the layer of varnish 302A to the substrate 300, and curing the varnish layer 302A before applying the pigmented ink layer 304A, the varnish layer 302A may act as a primer allowing the layer of pigmented ink 304A to better adhere to the substrate 300.

Alternatively, in the example of FIG. 3B, a layer of pigmented ink 304B may be applied to at least a portion of the substrate 300 (e.g., the same portion of the substrate), at substantially the same time that a layer of varnish 302B is applied. In addition to any ordinary definition or meaning to one skilled in the art, applying ink/varnish "at substantially the same time" includes applying ink/varnish at exactly the same time, applying ink/varnish with a print head ejecting both the ink/varnish via different print channels of the print head either simultaneously or sequentially but in the same pass of the print head over the substrate, or applying the ink and varnish within less than about one second of each other.

Applying the pigmented ink 304B and the varnish 302B at substantially the same time may allow the ink and the varnish to mix prior to curing or pinning, which in turn, may allow for better penetration of the UV light during the curing process resulting in a quicker, and more effective curing.

In the example of FIG. 3B the pigmented ink layer 304B may be applied to an entire portion of the substrate 300 (e.g., an entire front side or an entire back side) or a partial portion of the substrate 300 (e.g., part of a front or back side). The varnish layer 302B may be applied to just the portion of the substrate 300 to which the pigmented ink layer 304B is applied, allowing the varnish and the ink to mix prior to pinning or curing as described above. Alternatively, the varnish layer 302B may be applied to the entire portion of the substrate 300, or to some or all of an unprinted portion of the substrate 300 (the portion of the substrate 300 without the pigmented ink layer 304B applied). By applying the varnish layer 302B to the unprinted portion of the substrate 300, the varnish layer 302B and the pigmented ink layer 304B may be at the same level above the substrate 300, which may prevent unevenness or a ripple effect on the finished product.

Conversely, applying the varnish layer 302B just to the portion of the substrate 300 to which the pigmented ink layer 304B is applied allows for a more cost-effective and efficient printing because less varnish is required to be used during the printing process. Such an application of varnish and ink also allows for better penetration of the UV light from the UV cure lamp 102 when curing because the varnish and the pigmented ink may at least partially mix with each other prior to curing. This may allow for faster/quicker and more effective curing, which may also improve the durability of the pigmented ink layer 304B (e.g., preventing the ink from losing pigment, or otherwise degrading as quickly).

In the example of FIG. 3A, curing of the varnish or ink may take place at any point, such as after the application of the varnish layer 302A before the application of the pigmented ink layer 304A, and again after the application of the pigmented ink layer 304A. Similarly, in the example of FIG. 3B, curing may be performed after the combination of pigmented ink and varnish are applied to the substrate so that the ink and varnish are cured together. Alternatively, if the pigmented ink layer 304B is applied to the substrate before the varnish layer 302B, curing may be performed after application of the pigmented ink layer 304B, before the application of the varnish layer 302B, and then again after the application of the varnish layer 302B. Thus, providing intermediate curing and final curing. Any of the curing steps may include pinning or gelling, meaning curing using the UV cure lamp in a relatively low-power state to apply a low dose of UV light such that the varnish or the ink is not fully cured/dried, but becomes thicker allowing for the application of another layer of ink or varnish as needed. The use of pinning may reduce the number of defects such as "fish eyes" (a circular bubbling of a printed ink film) on the final printed product.

In the example shown in FIG. 3C, an initial varnish layer 302C may be applied to the substrate 300, in a first/initial application, as an overcoat or primer layer. The initial varnish layer 302C may then be pinned using the UV cure lamp 102 in a low-power state, or even fully cured. Once the initial varnish layer 302C has undergone pinning or curing, the pigmented ink layer 304C and a second varnish layer 306 may be applied to at least a portion of the cured initial varnish layer 302C. The pigmented ink layer 304C and the second varnish layer 306 may be applied at substantially the same time as, or in the same printing pass over the varnished substrate as applying the pigmented ink layer 304C. By applying the pigmented ink layer 304C and the second varnish layer 306 at substantially the same time, the pigmented ink and the varnish may become at least partially mixed, and when cured or pinned using the UV cure lamp, may be cured more quickly and effectively, with the pigmented ink being more durable after curing.

Figure 4:
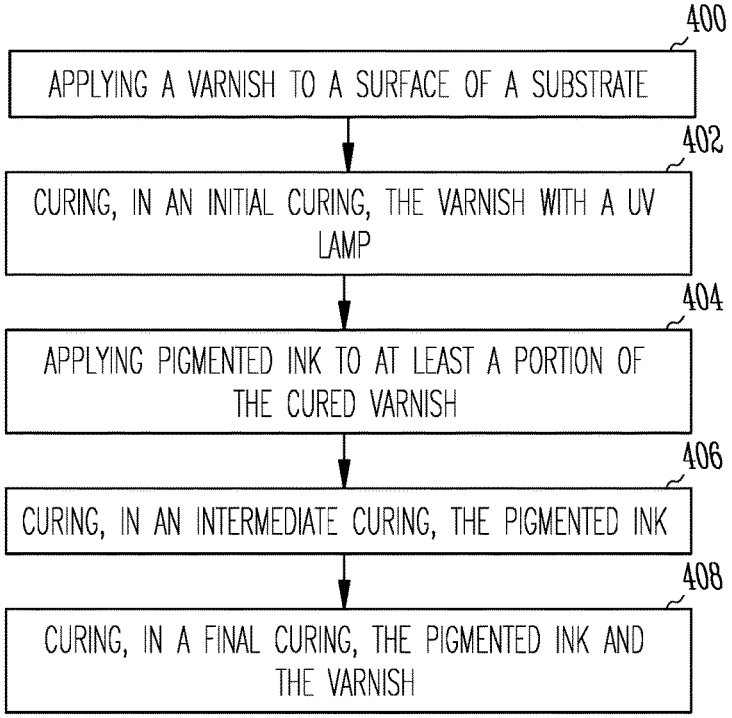
FIG. 4 illustrates an example method of improving ink jet ink durability and adhesion to a substrate.

FIG. 4 illustrates an example method of improving ink jet ink durability and adhesion to a substrate. Step 400 may include applying a varnish to at least a portion of a substrate, such as card substrate 108. At step 400 varnish may be applied to an entire surface of the substrate (e.g., a front side or a back side of a substantially flat substrate), or a portion of the surface of the substrate upon which pigmented ink may be applied (e.g., to just a portion of a front side or a back side of the substrate to which a picture, number, logo, or the like may be printed with pigmented ink). Step 402 may include curing, in an initial curing, the varnish with a UV lamp, such as UV cure lamp 102. The initial curing of step 402 may include pinning, as described above, to partially cure the varnish with the UV cure lamp 102 operating at a relatively lower-power so as to apply a dose of low UV light. This initial curing step 402 may allow the varnish to act as an overcoat layer on top of the substrate.

Step 404 may include applying a pigmented ink to at least a portion of the cured varnish. In an example, the pigmented ink may be a white or black ink. The pigmented ink may also or alternatively include colored ink, such as cyan, yellow, or magenta ink, or may include a combination of any pigmented inks as required for a particular print job. The pigmented ink may be applied in a single pass or multiple passes of the print heads 202, 204, 206. Step 406 may include curing, in an intermediate curing step, the pigmented ink after it is applied to the varnish. The intermediate curing 406 may include pinning the pigmented ink using the UV lamp 102 operating in a low-power state. This may be followed by step 408, which may include curing, for example in a final curing step, the pigmented ink and the varnish. This may include one or more passes of the UV cure lamp 102 operating at full power over the surface of the substrate to fully cure the combination of the varnish and the pigmented ink.

In an example of the method of FIG. 4, the initial curing step 402 and the intermediate curing step 406 may be a partial or semi-curing (pinning) or full curing. Further, either of steps 402 or 406 may be omitted entirely so the only curing is the final curing 408. Which curing steps are necessary and the extent of the curing in each curing step performed may be dependent on the requirements of the particular print job to be performed, and may vary from print job to print job.

Figure 5:
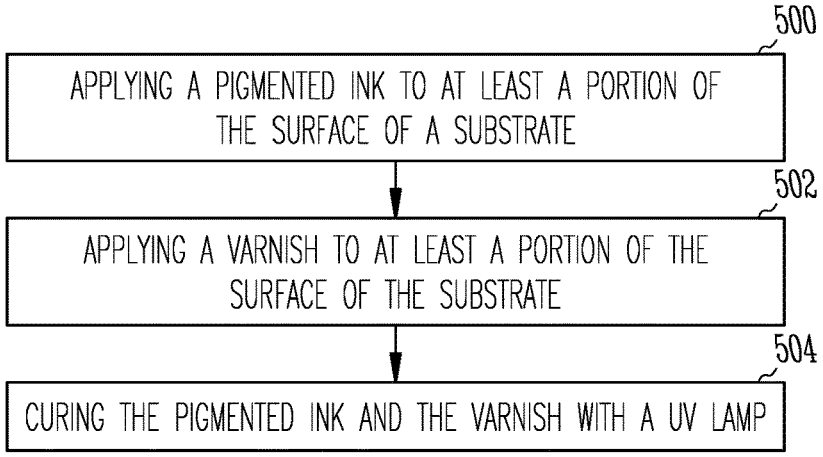
FIG. 5 illustrates an example method of improving ink jet ink durability and adhesion to a substrate.

FIG. 5 illustrates another example method of improving ink jet ink durability and adhesion to a substrate. Step 500 may include applying pigmented ink to at least a portion of a substrate, such as card substrate 108. In such an example, the pigmented ink may be applied directly to the substrate, without applying a layer of varnish first as in the method of FIG. 4. Step 502 may include applying varnish to at least a portion of the substrate. This may be the portion to which the pigmented ink was applied in operation 500, or to a "bare" portion of the substrate (e.g. a portion of the substrate without pigmented ink). Alternatively, the varnish may be applied to the entire surface of the substrate (e.g., both where pigmented ink is applied and to the "bare" portion of the substrate). When the varnish is applied at Step 502, it may be applied after the pigmented ink is applied at Step 500 (e.g., in a separate pass of the print heads 202, 204, 206) or at substantially the same time as the pigmented ink in Step 500 is applied (e.g., in the same pass with the print heads 202, 204, 206 as the pass in Step 500).

Applying the ink and varnish in steps 500 and 502 substantially simultaneously (e.g., as a focused ink/varnish application) may allow for better penetration of UV light when curing with the UV lamp, and may improve durability of the ink on the finished print. In an example of the method of FIG. 5, the application of the varnish in Step 502 may be applied to the "bare" portions of the substrate to which no pigmented ink is applied. This may "fill in" the substrate with varnish so that the pigmented ink applied in Step 500 and the varnish applied in Step 502 "sit" on the substrate at the same or substantially the same height, level, or the like, resulting in an even or substantially even surface after the pigmented ink and varnish is cured. This is in contrast to applying the varnish in Step 502 to the entire portion of the surface of the substrate after the ink is applied in Step 500, which may result in an uneven surface after the ink and varnish is cured.

Step 504 may include curing the ink and varnish applied in steps 500 and 502. Step 504 may include a semi-curing (pinning) or a full curing as described above, and may include a single pass or multiple passes of the UV cure lamp 102 over the substrate, such as card substrate 108.

Figure 6:
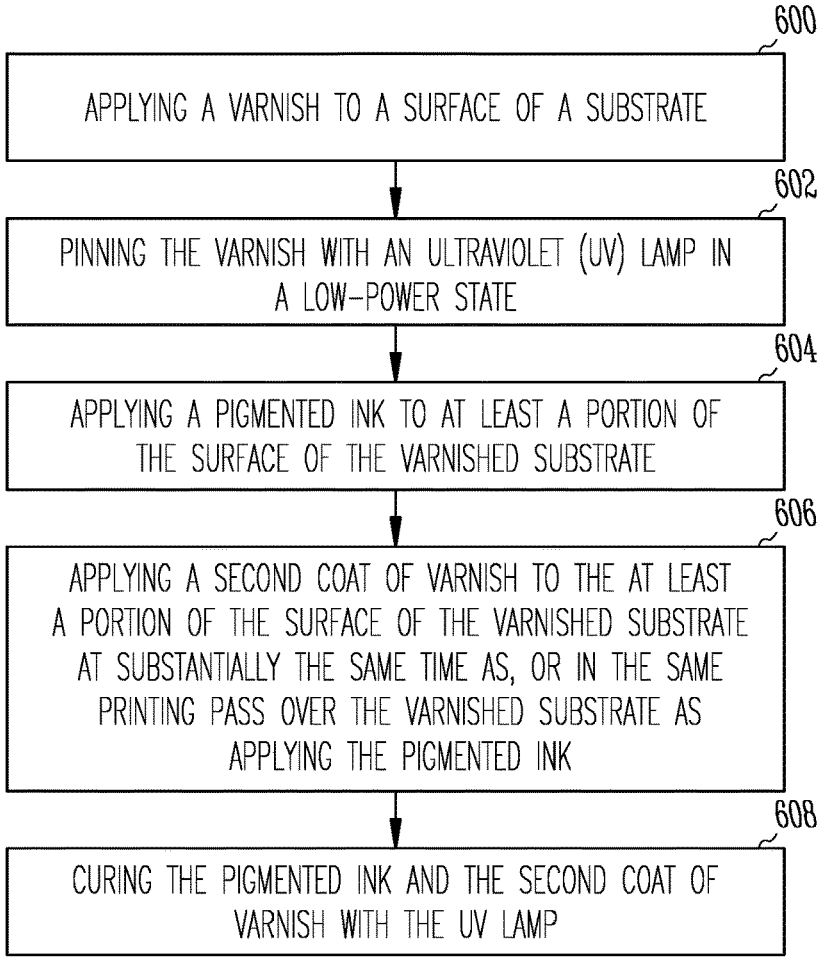
FIG. 6 illustrates an example method of improving ink jet ink durability and adhesion to a substrate.

FIG. 6 illustrates another example method of improving ink jet ink durability and adhesion to a substrate. Step 600 may include applying a varnish (as described above) to the surface of a substrate, such as card substrate 108. The varnish may be an unpigmented varnish/clear-coat or a varnish mixed with a fluorescent. Step 602 may include pinning the varnish with a UV lamp, such as UV cure lamp 102, operating in a low-power state. The application and pinning of the varnish layer applied in Step 600 may allow pinned varnish to act as a primer for subsequent applications of pigmented ink.

Steps 604 and 606 may include applying a pigmented ink and a second coat of varnish to at least a portion of the varnished substrate surface, at substantially the same time, or in the same pass. This may allow the pigmented ink applied in Step 604 and the varnish applied in Step 606 to at least partially mix, which may make the pigmented ink more durable, after curing, and the combination of the pigmented ink and the varnish may cure more quickly. Step 608 may include curing the pigmented ink and the second coat of varnish using the UV lamp. This may include pinning or semi-curing the pigmented ink and second coat of varnish with the UV lamp operating in a low-power state, or fully curing the pigmented ink and second coat of varnish.

It is understood that the methods described (e.g., of FIGS. 4-6) above are performed with an ink jet printer, containing the at least the components, or any similar components as described in FIG. 1 and FIG. 2, above. It is also understood that the methods, or individual steps of the methods may be performed in conjunction with each other, independent of each other, or performed as many times (e.g., repeated) as needed or desired.

Figure 7:
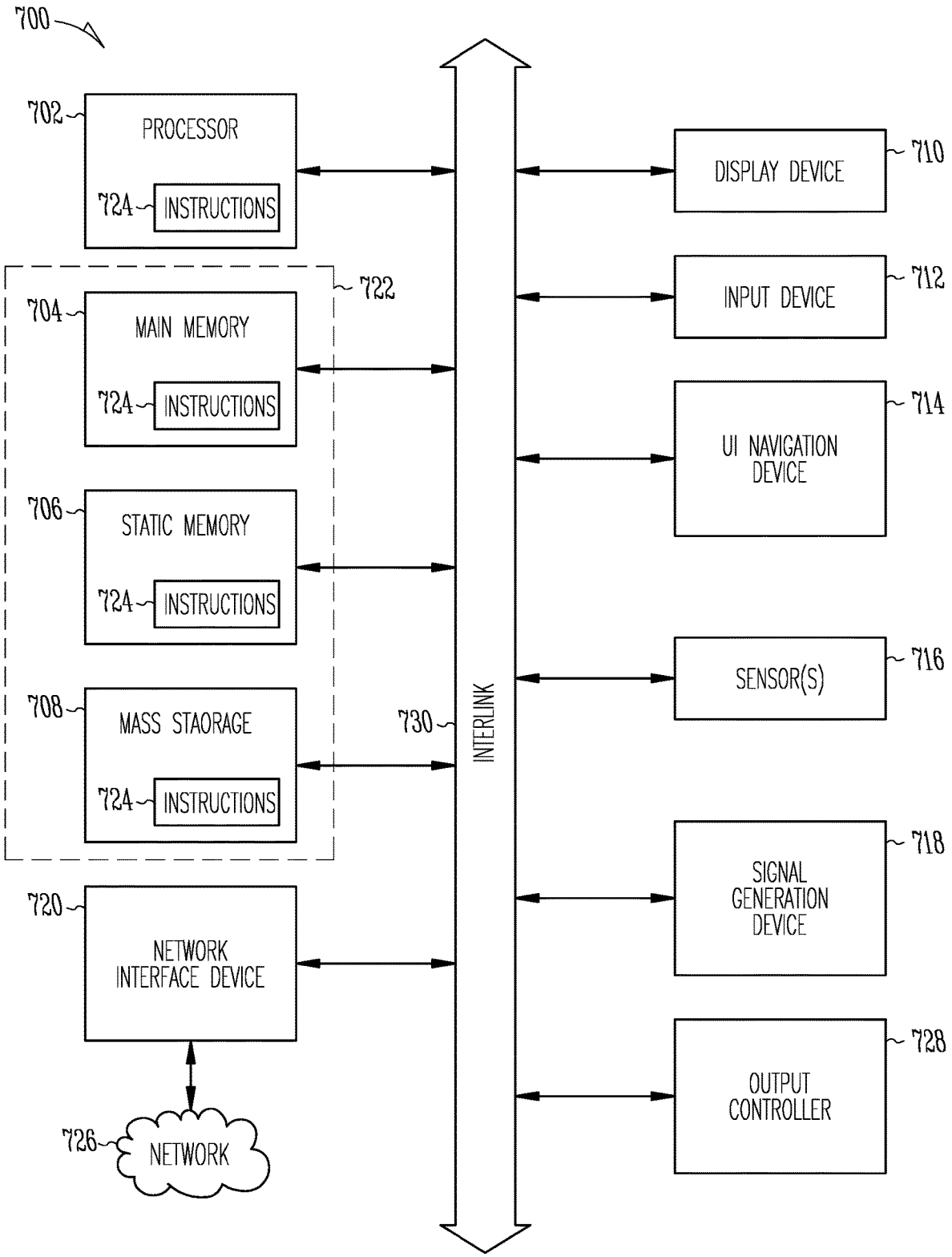
FIG. 7 illustrates an example of a block diagram of a machine upon which any one or more of the techniques discussed herein may perform.

FIG. 7 illustrates generally an example of a block diagram of a machine 700 upon which any one or more of the techniques (e.g., methodologies) discussed herein may perform in accordance with some embodiments. In alternative embodiments, the machine 700 may operate as a standalone device or may be connected (e.g., networked) to other machines. For example, the machine 700 may be a printer in which the system described above is included, or a part or component of the printer, a component operably connected to the printer, or the like. The machine 700 may also be a personal computer (PC), a tablet PC, a control system, a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

Examples, as described herein, may include, or may operate on, logic or a number of components, modules, or mechanisms. Modules are tangible entities (e.g., hardware) capable of performing specified operations when operating. A module includes hardware. In an example, the hardware may be specifically configured to carry out a specific operation (e.g., hardwired). In an example, the hardware may include configurable execution units (e.g., transistors, circuits, etc.) and a computer readable medium containing instructions, where the instructions configure the execution units to carry out a specific operation when in operation. The configuring may occur under the direction of the execution's units or a loading mechanism. Accordingly, the execution units are communicatively coupled to the computer readable medium when the device is operating. In this example, the execution units may be a member of more than one module. For example, under operation, the execution units may be configured by a first set of instructions to implement a first module at one point in time and reconfigured by a second set of instructions to implement a second module.

Machine (e.g., computer system) 700 may include a hardware processor 702 (e.g., a central processing unit (CPU), a graphics processing unit (GPU), a hardware processor core, or any combination thereof), a main memory 704 and a static memory 706, some or all of which may communicate with each other via an interlink (e.g., bus) 730. The machine 700 may further include a display unit 710, an alphanumeric input device 712 and a user interface (UI) navigation device 714. In an example, the display unit 710, alphanumeric input device 712 and UI navigation device 714 may be a touch screen display. The machine 700 may additionally include a storage device (e.g., drive unit) 708, a signal generation device 718 (e.g., a speaker), a network interface device 720, and one or more sensors 716, such as a global positioning system (GPS) sensor, accelerometer, or other sensor. The machine 700 may include an output controller 728, such as a serial (e.g., universal serial bus (USB), parallel, or other wired or wireless (e.g., infrared (IR), near field communication (NFC), etc.) connection to communicate or control one or more peripheral devices (e.g., a printer, a card reader, or the like).

The storage device 708 may include a machine readable medium 722 that is non-transitory on which is stored one or more sets of data structures or instructions 724 (e.g., software) embodying or utilized by any one or more of the techniques or functions described herein. The instructions 724 may also reside, completely or at least partially, within the main memory 704, within static memory 706, or within the hardware processor 702 during execution thereof by the machine 700. In an example, one or any combination of the hardware processor 702, the main memory 704, the static memory 706, or the storage device 708 may constitute machine readable media.

While the machine readable medium 722 is illustrated as a single medium, the term "machine readable medium" may include a single medium or multiple media (e.g., a centralized or distributed database, or associated caches and servers) configured to store the one or more instructions 724.

The term "machine readable medium" may include any non-transitory medium that is capable of storing, encoding, or carrying instructions for execution by the machine 700 and that cause the machine 700 to perform any one or more of the techniques of the present disclosure, or that is capable of storing, encoding or carrying data structures used by or associated with such instructions. Non-limiting machine-readable medium examples may include solid-state memories, and optical and magnetic media. Specific examples of machine-readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 724 may further be transmitted or received over a communications network 726 using a transmission medium via the network interface device 720 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 720 may include one or more physical jacks (e.g., Ethernet, coaxial, or phone jacks) or one or more antennas to connect to the communications network 726. In an example, the network interface device 720 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 700, and includes digital or analog communications signals or other intangible medium to facilitate communication of such software.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally" free of an element may still actually contain such element as long as there is generally no significant effect thereof.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is to allow the reader to quickly ascertain the nature of the technical disclosure and is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

What is claimed is:

1. A system for improving ink jet ink durability and adhesion to a substrate, the system comprising:

a plurality of print heads;

at least one ultraviolet (UV) lamp moveable with the plurality of print heads;

a processor; and memory, including instructions stored thereon which, when executed by the processor, cause the processor to:

apply a pigmented ink to at least a portion of a surface of the substrate;

apply a varnish to at least a portion of the surface of the substrate at substantially a same time as the pigmented ink causing the pigmented ink and the varnish to at least partially mix together; and cure the pigmented ink and the varnish using the UV lamp.

2. The system of claim 1, wherein curing the pigmented ink and the varnish comprises pinning the pigmented ink and the varnish with the UV lamp in a low-power state.

3. The system of claim 1, wherein curing the pigmented ink and the varnish comprises fully curing the pigmented ink and the varnish using the UV lamp.

4. The system of claim 1, wherein at least one print head of the plurality of print heads includes a first channel and a second channel.

5. The system of claim 4, wherein at least one of the first channel or the second channel contains the varnish.

6. The system of claim 1, wherein the UV lamp is included as a part of a scan assembly.

7. The system of claim 6, wherein the scan assembly is configured to be attached to an x-y scanning gantry.

8. A system for improving ink jet ink durability and adhesion to a substrate, the system comprising:

a plurality of print heads;

at least one ultraviolet (UV) lamp moveable with the plurality of print heads;

a processor; and memory, including instructions stored thereon which, when executed by the processor, cause the processor to:

apply a pigmented ink to at least a portion of a surface of the substrate;

apply a varnish to at least a portion of the surface of the substrate in a same printing pass of a print head over the substrate in which the pigmented ink is applied, causing the pigmented ink and the varnish to at least partially mix together; and cure the pigmented ink and the varnish using the UV lamp.

9. The system of claim 8, wherein applying the varnish includes applying the varnish substantially only to at least a portion of the substrate containing the pigmented ink.

10. The system of claim 8, wherein curing the pigmented ink and the varnish comprises pinning the pigmented ink and varnish using the UV lamp in a low-powered state.

11. The system of claim 8, wherein applying the varnish includes applying the varnish to substantially the entire surface of the substrate after applying the pigmented ink.

12. The system of claim 8, wherein the instructions further cause the processor to:

prior to applying the pigmented ink to the at least a portion of the surface of the substrate, apply a first layer of varnish to at least a portion of the substrate; and pin the first layer of varnish with the UV lamp in a low-power state.

13. A system for improving ink jet ink durability and adhesion to a substrate, the system comprising:

a plurality of print heads;

at least one ultraviolet (UV) lamp moveable with the plurality of print heads;

a processor; and memory, including instructions stored thereon which, when executed by the processor, cause the processor to:

apply a first varnish coat to a surface of a substrate;

cure, in an initial curing step, the first varnish coat with the UV lamp; and apply a pigmented ink to at least a portion of the cured varnish.

14. The system of claim 13, wherein curing, in the initial curing step, comprises pinning the first varnish coat with the UV lamp in a low-power state.

15. The system of claim 13, wherein the instructions further cause the processor to:

apply a second varnish coat such that the pigmented ink and the second varnish coat at least partially mix together.

16. The system of claim 15, wherein the instructions further cause the processor to:

fully cure the pigmented ink, the first varnish coat, and the second varnish coat.

17. The system of claim 15, wherein applying the second varnish coat comprises applying the second varnish coat to substantially the entire surface of the substrate after applying the pigmented ink.

18. The system of claim 13, wherein the pigmented ink is a black ink or a white ink.

19. The system of claim 13, wherein the varnish comprises an unpigmented polymer.

* * * * *